US006777032B2

(12) United States Patent
Ogasahara et al.

(10) Patent No.: US 6,777,032 B2
(45) Date of Patent: Aug. 17, 2004

(54) PROCESS FOR PAINTING VEHICLE BODY

(75) Inventors: Toshifumi Ogasahara, Aki-gun (JP); Teruo Kanda, Aki-gun (JP); Yusuke Kamesako, Aki-gun (JP); Toshiyuki Sakoda, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 151 days.

(21) Appl. No.: 10/211,243

(22) Filed: Aug. 5, 2002

(65) Prior Publication Data

US 2003/0049383 A1 Mar. 13, 2003

(30) Foreign Application Priority Data

Aug. 6, 2001 (JP) ..... 2001-237702

(51) Int. Cl.[7] ..... B05D 3/02

(52) U.S. Cl. ..... 427/388.1; 427/385.5; 427/407.1; 427/409

(58) Field of Search ..... 427/385.5, 388.1, 427/407.1, 409

(56) References Cited

FOREIGN PATENT DOCUMENTS

| | | |
|---|---|---|
| JP | 10-216617 | 8/1998 |
| JP | 10-277478 | 10/1998 |
| JP | 10-296178 | 11/1998 |

*Primary Examiner*—Bernard Pianalto
(74) *Attorney, Agent, or Firm*—Nixon Peabody LLP; Donald R. Studebaker

(57) ABSTRACT

Painting a vehicle body comprising an exterior body portion, engine and cargo compartments and an interior door portion all of which are applied with an undercoat is completed by applying a gray intermediate coat to the exterior body portion, an intermediate coat to the engine and/or cargo compartments, a base coat comprising a single color base coat or a color base coat and a bright base coat to the interior door portion, a base coat comprising either a single color base coat or a color base coat and a bright base coat to the exterior body portion, a clear coat to the interior door portion and a clear coat to the exterior body portion in this order, each of the applications of coat being performed while coat layers formed preceding the each application of coat remain wet, and then baking and drying the coat layers all together.

25 Claims, 6 Drawing Sheets

PROCESS FOR PAINTING VEHICLE BODY

BACKGROUND OF THE INVENTION

1. Field of the Invention

The present invention relates to a process and a system for painting a vehicle body.

2. Description of Related Art

Painting a vehicle body, in particular an exterior body panel of a vehicle body that has a demand for attractive exterior appearance and durability properties, typically comprises an undercoat, an intermediate coat and an overcoat. The undercoat is often applied by electrodepositing a coating composition so as thereby to form an undercoat layer and finished by baking and drying the undercoat layer. The intermediate coat is applied by spraying a coating composition over the undercoat layer that has been baked and dried so as to form an intermediate layer, and then finished by baking and drying the intermediate coat layer. Finally, the overcoat is applied by spraying a coating composition over the intermediate coat layer that has been baked and dried so as to form an overcoat layer, and then finished by baking and drying the overcoat layer.

Application of coat for the overcoat of the vehicle body is not confined to only once and the number of times of the application of coat for the overcoat depends upon the type of coating composition and the grade of finish. For example, when using one selected from a group of solid coating compositions, the application of coat for the overcoat is often made only once. However, in the case where the overcoat is completed by applying a coat of a coating composition selected from the group of metallic coating compositions two times, a base coat of a color coating composition containing a metallic powder is applied first and then a clear coat is applied over the color base coat layer. Otherwise, a solid type coating composition is sometimes employed for the color base coat in place of the metallic powder contained coating composition. One of examples in which the overcoat is completed by applying a coat three times is the case of an overcoat comprising a bright coat. Specifically, after a coating composition for the color base coat that contains a metallic powder is applied first, a bright base coat is applied, and a clear coat is subsequently applied to finish the overcoat. In these multiple coating processes, the overcoat is performed by what is called a wet-on-wet application. That is, a succeeding coat is applied over the last coat layer which has not yet been dried, in other words, which remains still wet. The overcoat layers formed in the wet-on-wet application are finally baked and dried all together in an oven.

In the multiple coating processes including an application of a brightener material contained coating composition such as a coating composition containing mica, while a color base coat layer without containing a brightener material remains wet, a brightener material contained coating composition is sprayed so as to form a bright coat layer over the color base coat layer and then a coating material is applied so as to form a clear coat layer over the bright base coat layer that remains wet. These three coat layers are baked and dried all together in an oven. Such a process, that is called three coats-simultaneous baking process, is disclosed, for example, in Japanese Unexamined Patent Publication No. 10-277478.

As disclosed, for example, in Japanese Unexamined Patent Publication No. 10-296178, when using the three coats-simultaneous baking process for forming an overcoat by spraying a coating composition containing a brightener material to exterior body portion, the overcoat is completed in specific steps of spraying coating compositions in relation to a coat applied to an interior door portion (interior portions near a door). That is, an application of a color base coat to the interior door portion and thereafter to the exterior body portion, an application of a mica base coat to the exterior body portion and an application of a clear coat to the interior door portion and thereafter to the exterior body portion are sequentially performed in the wet-on-wet application in this order. All the coat layers formed on the exterior body portion and the interior door portion are simultaneously baked and dried together. The three-coats simultaneous baking process always has the necessity of both an application of an intermediate coat prior to an application of the overcoat and baking and drying the intermediate coat layer in advance of the application of the overcoat like the conventional painting processes.

It is also known, for example, from Japanese Unexamined Patent Publication No. 10-216617, that a color base coat is applied to form a color base coat layer over an intermediate coat layer that remains wet and then a clear coat is applied to form a clear coat layer over the color base coat layer that remains wet, and all the three coat layers are finally baked and dried together.

Meanwhile, as for the vehicle body painting, although the overcoat of the exterior body portion is of the most importance in view of attractive exterior appearance and durability properties, it is also necessary to paint an interior door portion, an engine compartment, a cargo compartment, etc. The interior door portion also has a demand for attractive interior appearance and also a demand for finished color and quality similar to those of the exterior body portion as the interior door portion is eye catching for occupants of the vehicle and conspicuous when the doors are open. Therefore, the overcoats applied to the interior door portion and the exterior body portion are generally identical in color and quality with each other.

Since the engine and cargo compartments are kept out of sight, there is less demand for attractive exterior appearance and durability properties, it is suffice for the coat of the engine and/or cargo compartments to be identical in color with or similar in color to the exterior body portion.

In designing vehicle body painting, it is necessary to consider an overspray problem in addition to respective coating requirements of the exterior body portion, the interior door portion and the engine and/or cargo compartments. That is, when applying a coat the exterior body portion, a coating composition is sprayed more than a little on the interior door portion and the engine and cargo compartments. A similar overspray problem occurs when applying a coat to the interior door portion or the engine and/or cargo compartments.

One aspect of the overspray problem is color mixing. That is, when a coat layer is partly sprayed with a coating composition, the part of the coat layer is mingled in color with the coating composition and is stained differently from the remaining part. Another aspect of the overspray problem is a defect of paintwork (a deterioration in the flatness and smoothness of coat layer). The defect of paintwork becomes marked when a coating composition is sprayed on a coat layer having been backed and dried once. However, the defect of paintwork is practically insignificant when a coating composition is sprayed on a coat layer remaining wet. This is because the coating composition is fused together with the coat layer before long.

In order to avoid the color mixing, a color intermediate coat is often applied by spraying a coating composition having a color identical with or similar to the overcoat. Specifically, while it is desirable to employ a gray coating composition for the intermediate coat from the viewpoint of cost, it is general in turn to apply a color intermediate coat to both the exterior body portion and the engine and/or cargo compartments for the purpose of preventing an occurrence of color mixing due to an overspray or to the engine and/or cargo compartments only. Further, it is expensive but effective to apply not intermediate coat but a color base coat that forms a part of an overcoat to the engine and/or cargo compartments.

If the step of baking and drying an intermediate coat layer that is essential in the conventional painting processes can be dispensable, the painting process offers a lot of advantages in terms of costs for installation of printing equipments and running costs. In addition, the painting process can be made intensive, so as to be contributive to increasing the design flexibility of manual or automatic painting works. This makes it possible to reduce painting costs more effectively. These advantages are more enhanced in the case where an application of an intermediate coat to the interior door portion is dispensed.

SUMMARY OF THE INVENTION

It is therefore an object of the present invention to provide a vehicle body painting process and system which eliminates the overspray problem and the step of baking and drying exclusively an intermediate coat layer with an effect of inexpensive and efficient vehicle body painting.

The foregoing object of the present invention is accomplished by a vehicle body painting process in which an intermediate coat and an overcoat are made in a wet-on-wet application and intermediate coat and overcoat layers are baked and dried all together.

According to a preferred embodiment of the present invention, the vehicle body painting process of painting a vehicle body comprising an exterior body portion, engine and cargo compartments and an interior door portion includes an application of an intermediate coat and an overcoat comprising at least a color base coat and a clear coat to at least the exterior body portion. The vehicle body painting process comprises the steps of a first coating step of applying said intermediate coat to said exterior body portion, a second coating step of applying with the intermediate coat to at least one of the engine and cargo compartments after the first coating step, a third coating step of applying the color base coat to the interior door portion at least after the first coating step, a fourth coating step of applying the color base coat to the exterior body portion after both the second coating step and the third coating step, a fifth coating step of applying the clear coat to the interior door portion after the fourth coating step, a sixth coating step of applying the clear coat to the exterior body portion at least after the fourth coating step; and a baking and drying step of baking and drying coat layers formed in the first through sixth coating steps after both the fifth coating step and the sixth coating step, wherein each of the second to sixth coating steps is made while the coat layers formed in the coating steps preceding the each coating step remain wet and the intermediate coat applied to the engine and cargo compartments is identical with either one of the intermediate coat and the color base coat and has a color identical with or similar to the color base coat. A coating composition such as selected from a group of brightener contained coating compositions and a group of solid coating compositions may be employed for the color base coat.

The vehicle body painting process has no necessity of baking and drying exclusively the intermediate coat layers, and hence eliminates installation of a baking and drying oven exclusive for the intermediate coat layers in a painting system, so that the painting process is advantageous in terms of costs for installation of printing equipments and running costs. In addition, since all coats are performed in the wet-on-wet application after an application of the intermediate coat, there occurs no defect of paintwork due to an overspray problem. Furthermore, the vehicle body painting process is made intensive resulting from the elimination of the step of baking and drying the intermediate coat layer and an application of the intermediate coat to the interior door portion, so as to increase the design flexibility of manual or automatic painting works and, in consequence, to reduce painting costs more effectively.

Application of coat to the interior door portion, the engine compartment or the cargo compartment is made by spraying a coating composition to the vehicle body from opposite sides, namely left and right spray booths in each coating station. The left and right spray booths are generally displaced from each other in a vehicle body carrying direction in which the vehicle body is carried so as to prevent a spray device operator at one of the spray booths from being dabbed with an overspray of coating composition from a spray device in the other spray booth. Although this displaced layout of the spray booths produces dead spaces in the vehicle body carrying direction, the number of dead spaces is four in total in the printing system which is quite small.

According to another preferred embodiment of the present invention, the vehicle body painting process of painting a vehicle body comprising an exterior body portion, engine and cargo compartments and an interior door portion includes an application of an intermediate coat and an overcoat comprising at least a color base coat, a bright base coat and a clear coat to at least the exterior body portion. The vehicle body painting process comprises the steps of a first coating step of applying an intermediate coat to the exterior body portion, a second coating step of applying an intermediate coat to at least one of the engine and cargo compartments after the first coating step, a third coating step of applying the color base coat to the interior door portion at least after the first coating step, a fourth coating step of applying the color base coat to the exterior body portion after both the second coating step and third coating step, a fifth coating step of applying the bright base coat to the exterior body portion after the fourth coating step, a sixth coating step of applying the bright base coat to the interior door portion at least after the fourth coating step, a seventh coating step of applying the clear coat to the interior door portion after both the fifth coating step and the sixth coating step, a eighth coating step of applying the clear coat to the exterior body portion after both the fifth coating step and the sixth coating step, and a baking and drying step of baking and drying coat layers formed in the first through eighth coating steps after both the seventh coating step and the eighth coating step, wherein each of the second to eighth coating steps is made while the coat layers formed in the coating steps preceding the each coating step remain wet and the intermediate coat applied to the engine and cargo compartments is identical with either one of the intermediate coat and the color base coat and has a color identical with or similar to the color base coat. A coating composition for the bright base coat may contain mica as a brightener material.

Like the previous embodiment, the vehicle body painting process has no necessity of baking and drying exclusively the intermediate coat layers, and hence eliminates installation of a baking and drying oven exclusive for the intermediate coat layers in a painting system, so that the painting process is advantageous in terms of costs for installation of printing equipments and running costs. In addition, since all coats are performed in the wet-on-wet application after an application of the intermediate coat, there occurs no defect of paintwork due to an overspray problem. Furthermore, the vehicle body painting process is made intensive resulting from the elimination of the step of baking and drying the intermediate coat layer and an application of the intermediate coat to the interior door portion, so as to increase the design flexibility of manual or automatic painting works and, in consequence, to reduce painting costs more effectively.

According to still another preferred embodiment of the present invention, the vehicle body painting process of painting a vehicle body comprising an exterior body portion, engine and cargo compartments and an interior door portion includes an application of an intermediate coat and an overcoat comprising at least a color base coat and a clear coat to at least the exterior body portion. The vehicle body painting process comprises the steps of a first coating step of applying the intermediate coat to the exterior body portion, a second coating step of applying the intermediate coat to at least one of the engine and cargo compartments after the first coating step, a third coating step of applying the intermediate coat to the interior door portion at least after the first coating step, a fourth coating step of applying the color base coat to the exterior body portion after both the second coating step and the third coating step, a fifth coating step of applying the color base coat to the interior door portion after both the second coating step and third coating step, a sixth coating step of applying the clear coat to the interior door portion after both the fourth coating step and the fifth coating step, a seventh coating step of applying the clear coat to the exterior body portion after both the fourth coating step and the fifth coating step, and a baking and drying step of baking and drying coat layers formed in the first through seventh coating steps after both the sixth coating step and the seventh coating step, wherein each of the second to seventh coating steps is made while the coat layers formed in the coating steps preceding the each coating step remain wet and the intermediate coat applied to the engine and cargo compartments is identical with either one of the intermediate coat and the color base coat and has a color identical with or similar to the color base coat. In this embodiment, a coating composition such as selected from a group of brightener contained coating compositions and a group of solid coating compositions may be employed for the color base coat.

Like the previous embodiments, the vehicle body painting process has no necessity of baking and drying exclusively the intermediate coat layers, and hence eliminates installation of a baking and drying oven exclusive for the intermediate coat layers in a painting system, so that the painting process is advantageous in terms of costs for installation of printing equipments and running costs. In addition, since all coats are performed in the wet-on-wet application after an application of the intermediate coat, there occurs no defect of paintwork due to an overspray problem. Furthermore, the vehicle body painting process is made intensive resulting from the elimination of the step of baking and drying the intermediate coat layer and an application of the intermediate coat to the interior door portion, so as to increase the design flexibility of manual or automatic painting works and, in consequence, to reduce painting costs more effectively.

In the respective embodiments, the application of the color base coat to the interior door portion may be made directly after the application of the intermediate coat to the engine and cargo compartments. In this instance, there occurs no overspray problem in connection with the interior door portion upon an application of the intermediate coat to the engine and/or cargo compartment. This is desirable to finish the exterior body portion to a satisfactory paintwork properties.

Further, a coating composition for the intermediate coat applied to the exterior body portion may be gray in color. In this instance, inexpensive coating compositions can be employed for the intermediate coat. In addition, a coating composition for the intermediate coat applied to the engine and/or cargo compartments may be identical with that for the color base coat. This makes it possible to employ inexpensive coating compositions for the engine and/or cargo compartments that are identical in color with the exterior body portion.

In the second embodiment, the application of the bright base coat to the interior door portion may be made directly after the application of the bright base coat to the exterior body portion. In this instance, the vehicle body painting system has a significantly small number of, specifically only four, dead spaces in the vehicle body carrying direction. The applications of the bright base coat to the interior door portion and the application of the bright base coat to the exterior body portion may be made in reverse order. In this instance, since the same coating composition is sprayed on the exterior body portion prior to the interior door portion, this is desirable to finish the exterior body portion to a satisfactory paintwork properties.

In the third embodiment of the present invention, the application of the color base coat to the interior door portion may be made directly after the application of the color base coat to the exterior door portion. In addition, the application of the intermediate coat to the interior door portion and the application of the color base coat to the exterior body portion may be made directly after the application of the intermediate coat to the engine and cargo compartments and the application of the intermediate coat to the interior door portion, respectively. This is contributory to laying out the vehicle body painting system so as to have dead spaces as small in number as possible.

Furthermore, the application of the color base coat to the exterior body portion may be made directly after the application of the color base coat to the interior door portion. This is desirable to finish the exterior body portion to a satisfactory paintwork properties.

According to a further preferred embodiment of the present invention, the vehicle body painting process of painting a vehicle body comprising an exterior body portion, engine and cargo compartments and an interior door portion includes an application of an intermediate coat and an overcoat comprising at least a color base coat and a clear coat to at least the exterior body portion. The vehicle body comprising an exterior body portion, engine and cargo compartments and an interior door portion includes an application of an intermediate coat and an overcoart comprising at least a color base coat to at least the exterior body portion. The vehicle body painting process comprising the steps of a first coating step of applying the intermediate coat to the exterior body portion, a second coating step of applying the intermediate coat to at least one of the engine and cargo compartments after the first coating step, a third coating step of applying the color base coat to the interior door portion at least after the first coating step, a fourth coating step of applying the color base coat to the exterior body portion after both the second coating step and the third coating step, and a baking and drying step of baking and drying coat layers formed in the first through fourth coating steps after the fourth coating step, wherein each of the second to fourth coating steps is made while the coat layers formed in the steps preceding the each step remain wet, a coating composition for the color base coat comprises one selected from a group of solid coating compositions, and the intermediate coat applied to the engine and cargo compartments is identical with either one of the intermediate coat and the color base coat and has a color either identical with or similar to the color base coat.

The vehicle body painting process has no necessity of baking and drying exclusively the intermediate coat layers, and hence eliminates installation of a baking and drying oven exclusive for the intermediate coat layers in a painting system, so that the painting process is advantageous in terms of costs for installation of printing equipments and running costs. In addition, since all coats are performed in the wet-on-wet application after an application of the intermediate coat, there occurs no defect of paintwork due to an overspray problem. Furthermore, the vehicle body painting process is made intensive resulting from the elimination of the step of baking and drying the intermediate coat layer and an application of the intermediate coat to the interior door portion, so as to increase the design flexibility of manual or automatic painting works and, in consequence, to reduce painting costs more effectively.

On the other hand, the foregoing object of the present invention is accomplished by a vehicle body painting system for carrying out the vehicle body painting process according to each of the preferred embodiments.

According to a preferred embodiment of the present invention that realizes the vehicle body painting process of the first embodiment, the vehicle body painting system for painting a vehicle body comprising an exterior body portion, engine and cargo compartments and an interior door portion includes a plurality of coating stations through which an intermediate coat and an overcoat comprising at least a color base coat and a clear coat are applied to at least the exterior body portion.

Specifically, the vehicle body painting system comprises a first coating station where application of an intermediate coat to the exterior body portion is made, a second coating station where either one of an application of the color base coat to the interior door portion and an application of the intermediate coat to the engine and cargo compartments is made, a third coating station where another one of the application of the color base coat to the interior door portion and the application of the intermediate coat to the engine and cargo compartments is made, a fourth coating station where an application of the color base coat to the exterior body portion, a fifth coating station where an application of the clear coat to either one of the interior door portion and the exterior body portion, a sixth coating station where an application of the clear coat to another one of the interior door portion and the exterior body portion, and a baking and drying station where coat layers formed in the first through fifth stations are baked and dried, wherein each of the applications of coat in the first to sixth stations is made while the coat layers formed in the coating stations preceding each the application of coat remain wet and the intermediate coat applied to the engine and cargo compartments is identical with either one of the intermediate coat and the color base coat and has a color identical with or similar to the color base coat.

According to another preferred embodiment of the present invention that realizes the vehicle body painting process of the second embodiment, the vehicle body painting system for painting a vehicle body comprising an exterior body portion, engine and cargo compartments and an interior door portion includes a plurality of coating stations through which an intermediate coat and an overcoat comprising at least a color base coat, a bright base coat and a clear coat are applied to at least the exterior body portion.

Specifically, the vehicle body painting system comprises a first coating station where application of an intermediate coat to the exterior body portion is made, a second coating station where either one of an application of the color base coat to the interior door portion and an application of the intermediate coat to the engine and cargo compartments is made, a third coating station where another one of the application of the color base coat to the interior door portion and the application of the intermediate coat to the engine and cargo compartments is made, a fourth coating station where an application of the color base coat to the exterior body portion, a fifth coating station where an application of the bright base coat to either one of the exterior body portion and the interior door portion, a sixth coating station where an application of the bright base coat to another one of the exterior body portion and the interior door portion, a seventh coating station where an application of the clear base coat to either one of the exterior body portion and the interior door portion, a eighth coating station where an application of the clear base coat to another one of the exterior body portion and the interior door portion, and a baking and drying station where coat layers formed in the first through eighth stations are baked and dried, wherein each of the applications of coat in the second to eighth coating stations is made while the coat layers formed in the coating stations preceding the each the application of coat remain wet and the intermediate coat applied to the engine and cargo compartments is identical with either one of the intermediate coat and the color base coat and has a color identical with or similar to the color base coat.

According to still another preferred embodiment of the present invention that realizes the vehicle body painting process of the third embodiment, the vehicle body painting system for painting a vehicle body comprising an exterior body portion, engine and cargo compartments and an interior door portion includes a plurality of coating stations through which an intermediate coat and an overcoat comprising at least a color base coat and a clear coat are applied to at least the exterior body portion.

Specifically, the vehicle body painting system comprises a first coating station where an application of the intermediate coat to the exterior body portion, a second coating station where either one of an application of the color base coat to the interior door portion and an application of the intermediate coat to the engine and cargo compartments is made, a third coating station where another one of the application of the color base coat to the interior door portion and the application of the intermediate coat to the engine and cargo compartments is made, a fourth coating station where an application of the color base coat to either one of the exterior body portion and the interior door portion, a fifth coating station where an application of the color base coat to another one of the exterior body portion and the interior door portion, a sixth coating station where an application of the clear coat to either one of the exterior body portion and the interior door portion is made, a seventh coating station where an application of the clear coat to another one of the exterior body portion and the interior door portion; and a baking and drying stations where coat layers formed in the first through seventh coating stations are baked and dried; wherein each of the applications of coat in the second to eighth coating stations is made while the coat layers formed in the coating stations preceding the each the application of coat remain wet and the intermediate coat applied to the engine and cargo compartments is identical with either one of the intermediate coat and the color base coat and has a color identical with or similar to the color base coat.

According to a further preferred embodiment of the present invention that realizes the vehicle body painting process of the fourth embodiment, the vehicle body painting system for painting a vehicle body comprising an exterior body portion, engine and cargo compartments and an interior door portion includes a plurality of coating stations through which an intermediate coat and an overcoat comprising at least a color base coat and a clear coat are applied to at least the exterior body portion.

Specifically, the vehicle body painting system comprises a first coating station where an application of the intermediate coat to the exterior body portion, a second coating station where either one of an application of the color base coat to the interior door portion and an application of the intermediate coat to the engine and cargo compartments is made, a third coating station where another one of the application of the color base coat to the interior door portion and the application of the intermediate coat to the engine and cargo compartments is made, a fourth coating station where an application of the color base coat to the exterior body portion, and a baking and drying station where coat layers formed in the first through fourth coating stations are baked and dried, wherein each of the applications of coat in the second to fourth coating stations is made while the coat layers formed in the coating stations preceding the each application of coat remain wet, a coating composition for the color base coat comprises one selected from a group of solid coating compositions, and the intermediate coat applied to the engine and cargo compartments is identical with either one of the intermediate coat and the color base coat and has a color either identical with or similar to the color base coat.

BRIEF DESCRIPTION OF THE DRAWINGS

The above and other objects and features of the present invention will be understood from the following description of a specific embodiment thereof when considering in conjunction with the accompanying drawings, wherein similar reference numerals have been used to denote the same or similar parts throughout the drawings, and in which.

DETAILED DESCRIPTION OF THE SPECIFIC EMBODIMENT

In the following description, the term "exterior body portion" shall mean and generally refer to exterior portions of a vehicle body that are always eye-catching and visible from the outside of the vehicle body and include, for example, an engine compartment hood, a roof, a cargo rid, fenders, bumpers, door exterior panels, and the like. Further, the term "interior door portion" shall mean and generally refer to interior portions around the doors that are always visible in the inside of the vehicle body while doors are closed and portions such as, for example, door inner panels, portions of wheel arches, door shills and the like that are conspicuous from the outside of the vehicle body while the doors are open.

Figure 1:
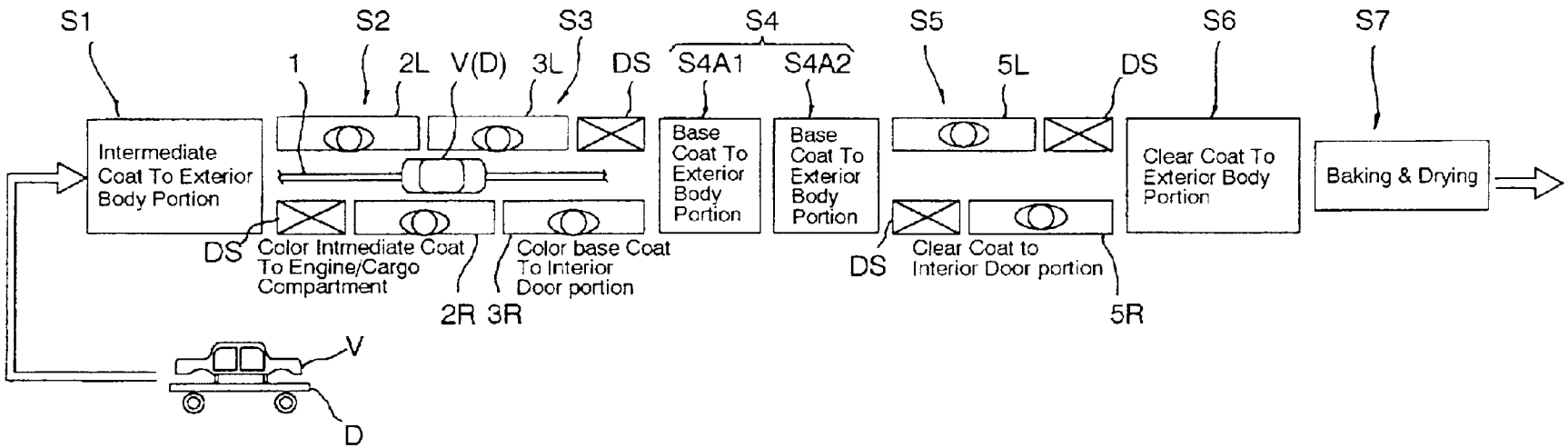
FIG. 1 is an illustration showing a painting line for carrying out a painting process according to an embodiment of the present invention.

FIG. 1 shows a vehicle body painting line for painting a vehicle body in a process according to an embodiment of the present invention. A vehicle body V comprises an exterior body portion, an interior door portion, an engine compartment at the front thereof and a cargo compartment at the rear end thereof and is, however, not yet attach with side doors. An undercoat has been applied using an electrodepositing process by which an undercoat layer is formed on all portions and compartments of the vehicle body V dipped in a coating composition bath. The undercoat layer has been baked and dried in a conventional oven. The vehicle body V is placed on a carrier D and is carried through a painting line including first to sixth coating stations S1 to S6 and a finishing station S7. Although the carrier D is towed by a towing device including a towing wire or a towing chain 1, it may be of a self-propelled type. The carrier D carries the vehicle body V to a first coating station S1 where an intermediate coat is applied to the exterior body portion of the vehicle body V using a robot or an automatic spray device, or otherwise using a manually operated spray device. A gray coating composition that is comparatively cheep is employed for the intermediate coat.

After the application of the intermediate coat to the exterior body portion of the vehicle body V in the first coating station S1, the carrier D carries the vehicle body V into between right and left spray booths 2R and 2L in a second coating station S2 where a color intermediate coat is applied to at least one of an engine compartment and a cargo compartment of the vehicle body V using a robot or an automatic spray device, or otherwise using manually operated spray device. The color of the color intermediate coat is identical with or similar to a color of a color base coat forming a part of an overcoat applied to the exterior body portion of the vehicle body V in a coating station S4 that will be described later. The application of the color intermediate coat to the engine and/or cargo compartments of the vehicle body V is made while the gray intermediate coat layer formed on the exterior body portion of the vehicle body V remains still wet. The color intermediate coat is applied by spraying a color coating composition on the engine and/or cargo compartments of the vehicle body V from the right and left spray booths 2R and 2L on opposite sides of the vehicle body V. These right and left spray booths 2R and 2L are little displaced from each other in a vehicle body carrying direction in which the vehicle body V on the carrier D is carried in order to prevent a spray device operator on a side opposite to each spray device from being dabbed with an overspray of coating composition from the spray device.

After the application of the color intermediate coat to the engine and/or cargo compartments of the vehicle body V in the second coating station S2, the carrier D carries the vehicle body V to a third coating station S3 where a color base coat forming a part of the overcoat is applied to the interior door portion of the vehicle body V using a robot or an automatic spray device, or otherwise a manually operated spray device. A coating composition employed for the color base coat that substantially determines a finished color of the exterior body portion of the vehicle body V may be of a metallic type that contains a brightener material such as a metal powder (for example an aluminum powder) or the like, or of a solid type that does not contain a brightener material. The application of the color base coat to the interior door portion of the vehicle body V is made while the gray intermediate coat layer formed on the exterior body portion of the vehicle body V in the first coating station S1 and the color intermediate coat layer formed on the interior door portion of the vehicle body V in the second coating station S2 remain still wet. The color base coat is applied by spraying a color coating composition from right and left spray booths 3R and 3L on opposite sides of the vehicle body V. These right and left spray booths 3R and 3L are little displaced from each other in the vehicle body carrying direction of the vehicle body V on the carrier D in order to prevent a spray device operator on a side opposite to each spray device from being dabbed with an overspray of coating composition from the spray device.

After the application of the color base coat to the interior door portion of the vehicle body V in the third coating station S3, the carrier D carries the vehicle body V to a fourth coating station S4 where the color base coat forming a part of the overcoat is applied to the exterior body portion of the vehicle body V twice using a robot or an automatic spray device, or otherwise using a manually operated spray device. The fourth coating station S4 comprises a first substations S4A1 for the color base coat for the first time (first color base coat) and a second substation S4A2 for the color base coat for the second time (second color base coat). The application of the first color base coat to the exterior body portion of the vehicle body V is made while the coat layers formed on the vehicle body V in the first through third coating stations S1–S3 remain still wet. Similarly, the application of the second color base coat to the exterior body portion of the vehicle body V is made while the coat layers formed on the vehicle body V in the first to third coating stations S1–S3 and in the first substation S4A1 of the fourth coating station S4 remain still wet.

After the application of the first and second color base coats to the exterior body portion of the vehicle body V in the first and second substations S4A1 and S4A2 of the fourth coating station S4, the carrier D carries the vehicle body V to a fifth coating station S5 where a clear coat forming a part of the overcoat is applied to the interior door portion of the vehicle body V using a robot or an automatic spray device, or otherwise using a manually operated spray device. The application of the clear coat to the interior door portion of the vehicle body V is made while the coat layers formed on the vehicle body V in the first through fourth coating stations S1–S4 remain still wet. The clear coat is applied by spraying a clear coating composition from right and left spray booths 5R and 5L on opposite sides of the vehicle body V. These right and left spray booths 5R and 5L are little displaced from each other in the vehicle body carrying direction in order to prevent a spray device operator at a side opposite to each spray device from being dabbed with an overspray of coating composition from the spray device.

Subsequently to the application of the clear coat to the interior door portion of the vehicle body V in the fifth coating station S5, the carrier D carries the vehicle body V to a sixth coating station S6 where a clear coat forming a part of the overcoat is applied to the exterior body portion of the vehicle body V using a robot or an automatic spray device, or otherwise using manually operated spray device. The application of the clear coat to the exterior body portion of the vehicle body V is made while the coat layers formed on the vehicle body V in the first through fifth coating stations S1–S5 remain still wet.

Finally, after the application of the clear coat to the exterior body portion of the vehicle body V in the sixth coating station S6, the carrier D carries the vehicle body V to a finishing station S7 where the coat layers formed on the vehicle body V all of which remain wet are baked and dried all together in a baking and drying oven. Various baking and drying ovens are known in various forms and the baking and drying oven may take any form well known to those in the art. The vehicle body V finished by baking and drying the coat layers is transported to a vehicle body assembly line (not shown).

As shown FIG. 1, there are a plurality of dead spaces DS, specifically four in this embodiment that is small in number, in the coating stations S2, S3 and S5 in the painting line resulting from a displacement of the right and left spray booths from each other in the vehicle body carrying direction. Specifically, there is one dead space DS adjacent to each of the right spray booth 2R in the second coating station S2, the left spray booth 3L in the third coating station S3 and the right and left spray booths 5R and 5L in the fifth coating station S5. The total number of dead spaces DS, that is four in this embodiment, is desirable in viewpoint of providing the overall path length of the painting line as short as possible.

Figure 2:
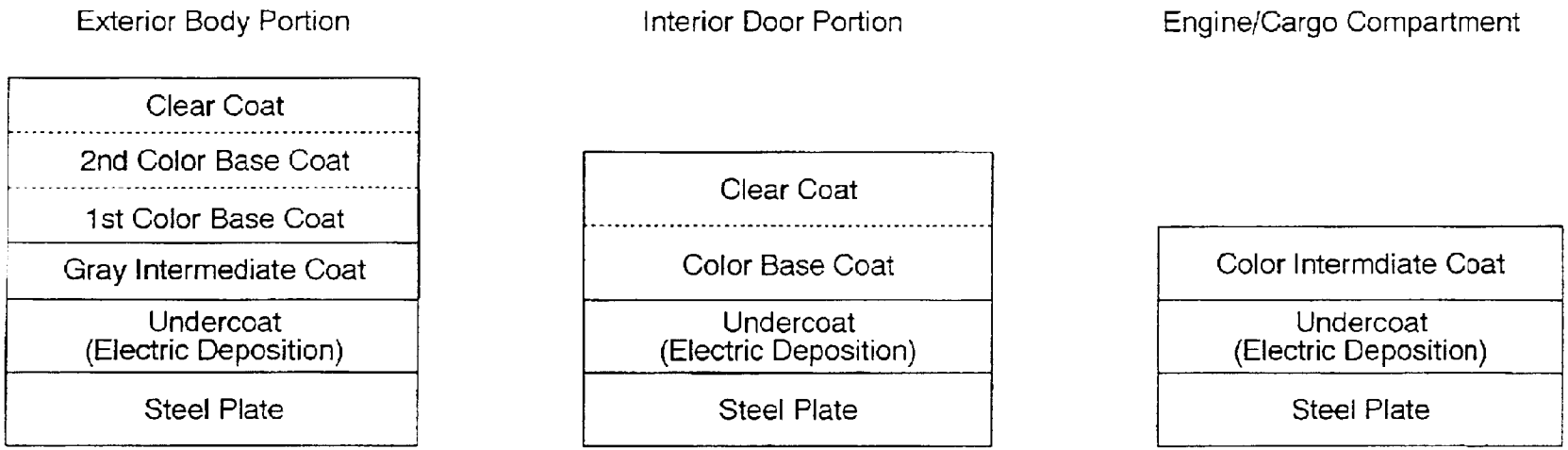
FIG. 2 is an illustration of coating structures of the respective portions of a vehicle body, namely an exterior body portion, engine and cargo compartments and an interior door portion, painted in the painting line of FIG. 1.

FIG. 2 shows a coating structure of the respective portions of the vehicle body V, namely the exterior body portion, the interior door portion and the engine and/or cargo compartments, formed in the vehicle body painting line of FIG. 1. As was previously described, a steel panel and an undercoat which is applied to the steel panel are common to the respective portions of the vehicle body V. The gray coating composition for the intermediate coat can be the cheapest among coating compositions for the intermediate coat and the overcoat. No intermediate coat is applied to the interior door portion of the vehicle body V. Further, in order to finish the engine and/or cargo compartments to the same or a similar color of the exterior body portion, only the color intermediate coat is applied. This makes the vehicle body painting inexpensive.

The vehicle body painting line has no necessity of incorporating an oven exclusive to baking and drying the intermediate coat layers, therefore, it is possible to cut costs, namely costs of painting appliances and a painting cost, and to reduce energy consumption and painting time. In addition, the vehicle body painting process is made effectively intensive in the vehicle body painting line and increases the design flexibility of painting works.

Examining the quality of paintwork of the vehicle body V in connection with an overspray, since an application of individual coat is made while all coat layers formed previous to the individual coat remain wet, there occurs no defects of paintwork. Further, since there is no overspray of a coating composition of a color different from a desired color, there does not in any way occur a problem in color mixing due to an overspray. If the intermediate coat were applied to the exterior body portion of the vehicle body V after an application of the color intermediate coat to the engine and/or cargo compartments of the vehicle body V, it is necessary for the intermediate coat to employ a color coating composition other than a gray coating composition for the intermediate coat of the exterior body portion.

Figure 3:
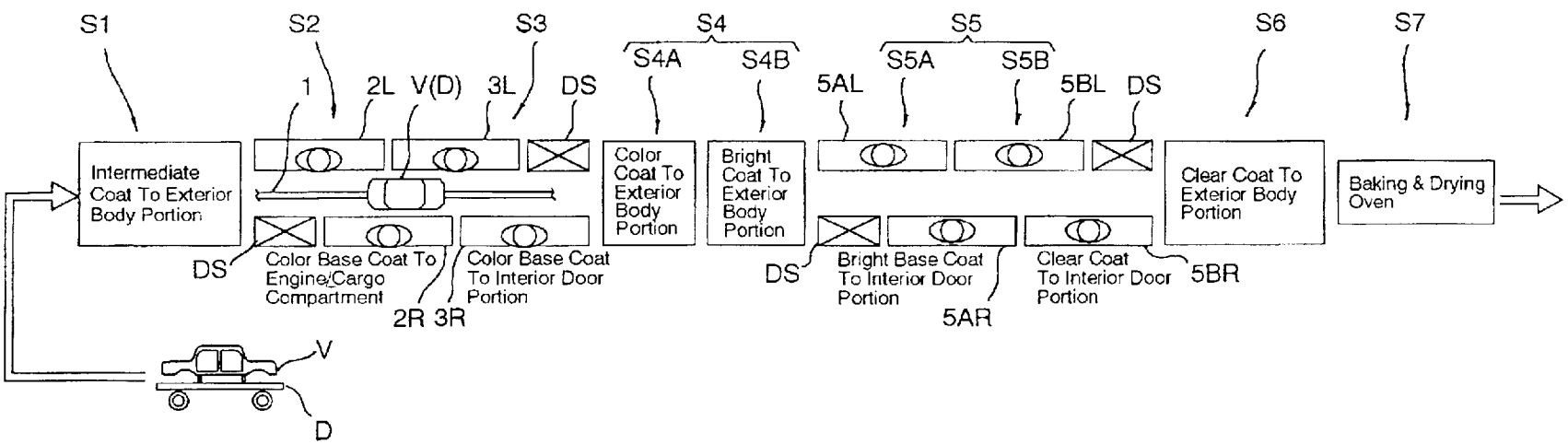
FIG. 3 is an illustration showing a painting line for carrying out a painting process according to another embodiment of the present invention.

FIG. 3 shows a vehicle body painting line for painting a vehicle body in a process according to another embodiment of the present invention in which an overcoat comprising a first and second base coats and a clear coat applied to both exterior body portion and interior door portion of the vehicle body V. In the process of applying the overcoat, the first base coat employs a color coating composition containing no brightener material and is therefore referred to as a color base coat, and the second base coat employs a coating composition containing a brightener material such as bright and is therefore referred to as a bright base coat. An undercoat has been applied using an electrodepositing process by which an undercoat layer is formed on all portions and compartments of the vehicle body V dipped in a coating composition bath. The undercoat layer has been baked and dried in a conventional oven. The vehicle body V is placed on the carrier D that is towed by a towing device 1 through a painting line including first to sixth coating stations S1 to S6 and a finishing station S7. The fourth coating station S4 where the base coat is applied to the exterior body portion of the vehicle body V includes a first substation S4A for the color base coat and a second substation S4B for the bright base coat. Similarly, the fifth coating station S5 where the base coat is applied to the interior door portion of the vehicle body V includes a first substation S5A for the color base coat and a second substation S5B for the bright base coat.

When the vehicle body V placed on a carrier D is carried to a first coating station S1, a gray intermediate coat is applied to the exterior body portion of the vehicle body V using a robot or an automatic spray device, or otherwise using a manually operated spray device. After the application of the gray intermediate coat to the exterior body portion of the vehicle body V in the first coating station S1, the vehicle body V is carried to between right and left spray booths 2R and 2L in a second coating station S2 where a color intermediate coat is applied to engine and/or cargo compartments of the vehicle body V using a robot or an automatic spray device or otherwise using a manually operated spray device. The color of the color intermediate coat is identical with or similar to that of a color base coat forming a part of the overcoat that is applied to the exterior body portion of the vehicle body V in coating station S4 that will be described later. The application of the color intermediate coat to the engine and/or cargo compartments of the vehicle body V is made while the gray intermediate coat layer formed on the exterior body portion of the vehicle body V remains still wet. The color intermediate coat is applied by spraying a color coating composition from right and left spray booths 2R and 2L on opposite sides of the vehicle body V. These right and left spray booths 2R and 2L are little displaced from each other in the vehicle body carrying direction in order to prevent a spray device operator on a side opposite to each spray device from being dabbed with an overspray of coating composition from the spray device.

After the application of the color intermediate coat to the engine and/or cargo compartments of the vehicle body V in the second coating station S2, the vehicle body V is carried to a third coating station S3 where a color base coat forming a part of the overcoat is applied to the interior door portion of the vehicle body V using a robot or an automatic spray device, or otherwise a manually operated spray device. A coating composition employed for the color base coat does not contain any brightener material and substantially determines a finished color of the exterior body portion of the vehicle body V. The application of the color base coat to the interior door portion of the vehicle body V is made while the gray intermediate coat layer formed on the exterior body portion of the vehicle body V in the first coating station S1 and the color intermediate coat layer formed on the engine and/or cargo compartments of the vehicle body V in the second coating station S2 remain still wet. The color base coat is applied by spraying a color coating composition from right and left spray booths 3R and 3L on opposite sides of the vehicle body V. These right and left spray booths 3R and 3L are little displaced from each other in the vehicle body carrying direction in order to prevent an spray device operator at a side opposite to each spray device from being dabbed with an overspray of coating composition from the spray device.

Subsequently to the application of the color base coat to the interior door portion of the vehicle body V in the third coating station S3, the vehicle body V is carried to a fourth coating station S4 where base coats forming a part of the overcoat is applied to the exterior body portion of the vehicle body V using a robot or an automatic spray device, or otherwise a manually operated spray device. The fourth coating station S4 comprises a first substations S4A for the color base coat and a second substation S4B for the bright base coat. An application of the color base coat to the exterior body portion of the vehicle body V is made while the coat layers formed on the vehicle body V in the first through third coating stations S1–S3 remain still wet. Similarly, an application of the bright base coat to the exterior body portion of the vehicle body V is made while the coat layers formed on the vehicle body V in the first to third coating stations S1–S3 and in the first substation S4A of the fourth coating station S4 remain still wet.

After the application of the color base and bright base coats to the exterior body portion of the vehicle body V in the first and second substations S4A and S4B of the fourth coating station S4, the vehicle body V is carried to a fifth coating station S5 where an overcoat comprising a bright base coat and a clear coat is applied to the interior door portion of the vehicle body V using a robot or an automatic spray device, or otherwise a manually operated spray device. Specifically, the fifth coating station S5 comprises a first substations S5A for the bright base coat and a second substation S5B for the clear coat. An application of the bright base coat to the interior door portion of the vehicle body V is made while the coat layers formed on the vehicle body V in the first through fourth coating stations S1–S4 remain still wet. Similarly, an application of the clear coat to the interior door portion of the vehicle body V is made while the coat layers formed on the vehicle body V in the first to fourth coating stations S1–S4 and in the first substation S5A of the fifth coating station S5 remain still wet. The bright base coat is applied by spraying a bright base coating composition from right and left spray booths 5AR and 5AL on opposite sides of the vehicle body V. These right and left spray booths 5AR and 5AL are little displaced from each other in the vehicle body carrying direction in order to prevent a spray device operator at a side opposite to each spray device from being dabbed with an overspray of coating composition from the spray device. Similarly, the clear coat is applied by spraying a clear coating composition from right and left spray booths 5BR and 5BL on opposite sides of the vehicle body V. These right and left spray booths 5BR and 5BL are little displaced from each other in the vehicle body carrying direction in order to prevent a spray device operator on a side opposite to each spray device from being dabbed with an overspray of coating composition from the spray device.

After the application of the overcoat, namely the bright base coat and the clear coat, to the interior door portion of the vehicle body V in the fifth coating station S5, the vehicle body V is carried to a sixth coating station S6 where a clear coat forming a part of the overcoat is applied to the exterior body portion of the vehicle body V using a robot or an automatic spray device, or otherwise a manually operated spray device. The application of the clear coat to the exterior body portion of the vehicle body V is made while the coat layers formed on the vehicle body V in the first through fifth coating stations S1–S5 remain still wet.

After the application of the clear coat to the exterior body portion of the vehicle body V in the sixth coating station S6, the vehicle body V is finally carried to a finishing station S7 where the coat layers formed on the vehicle body V all of which remain wet are baked and dried all together in a conventional baking and drying oven. The vehicle body V finished by baking and drying the coat layers is transported to an assembly line (not shown).

As shown FIG. 3, there are four dead spaces DS, that is small in number, in the coating stations S2, S3 and S5 in the painting line resulting from that the right and left spray booths in each of the coating stations S2, S3 and S5 are displaced from each other in the vehicle body carrying direction. Specifically, there is one dead space DS adjacent to each of the right spray booth 2R in the second coating station S2, the left spray booth 3L in the third coating-station S3, the right spray booth 5AR in the first substation S5A of the fifth coating station S5 and the left spray booth 5BL in the second sib-station S5B of the fifth coating station S5. The total number of dead spaces DS, that is four in this embodiment, is desirable in view of shortening the overall path length of the painting line as short as possible.

Figure 4:
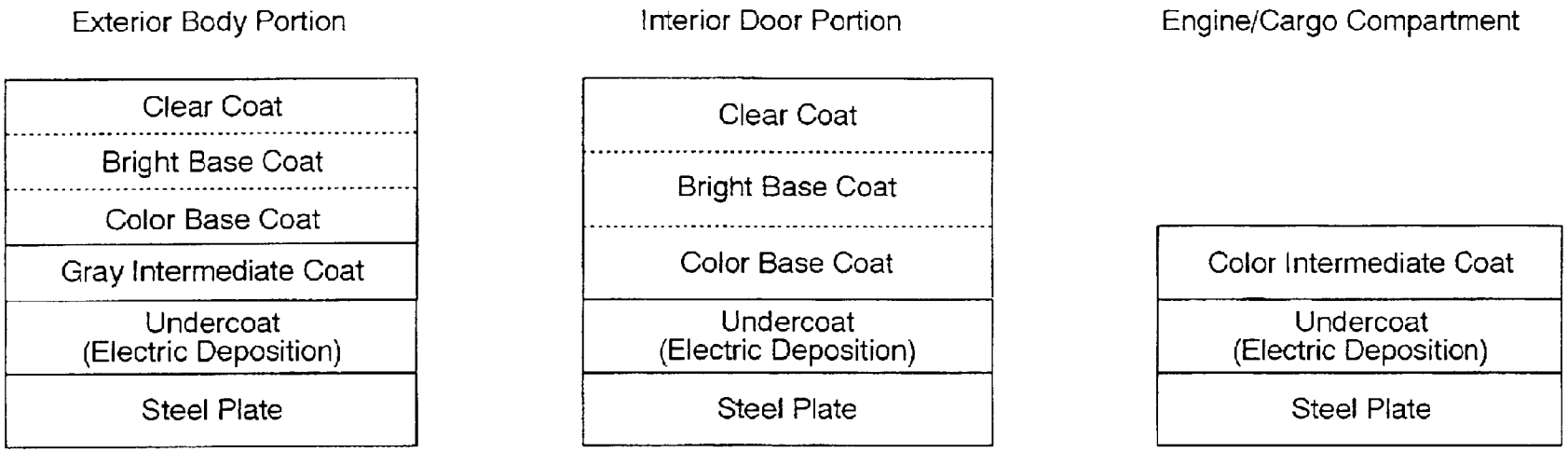
FIG. 4 is an illustration of coating structures of the respective portions of a vehicle body, namely an exterior body portion, engine and cargo compartments and an interior door portion, painted in the painting line of FIG. 3.

FIG. 4 shows a coating structure of the respective portions of the vehicle body V, namely the exterior body portion, the interior door portion and the interior of an engine or a cargo compartment of the vehicle body V, formed in the painting line of FIG. 3. As was described in connection with the previous embodiment, an undercoat and a steel panel to which the undercoat is applied are common to the respective portions of the vehicle body V. The gray coating composition that is comparatively cheap is employed for the intermediate coat applied to the exterior body portion of the vehicle body V. No intermediate coat is applied to the interior door portion of the vehicle body V. In order to finish the engine and/or cargo compartments to the same or a similar color of the exterior body portion, a color intermediate coat may be applied in place of the color base coat like the previous embodiment. Like the vehicle body painting line of the previous embodiment, the vehicle body painting line of this embodiment avoids the necessity of incorporating an oven exclusive to baking and drying the gray intermediate coat layers, therefore, it is possible to cut costs, namely costs of painting appliances and a painting cost, and to reduce energy consumption and painting time. In addition, the vehicle body painting process is made effectively intensive in the vehicle body painting line and increases the design flexibility of painting works.

Figure 5:
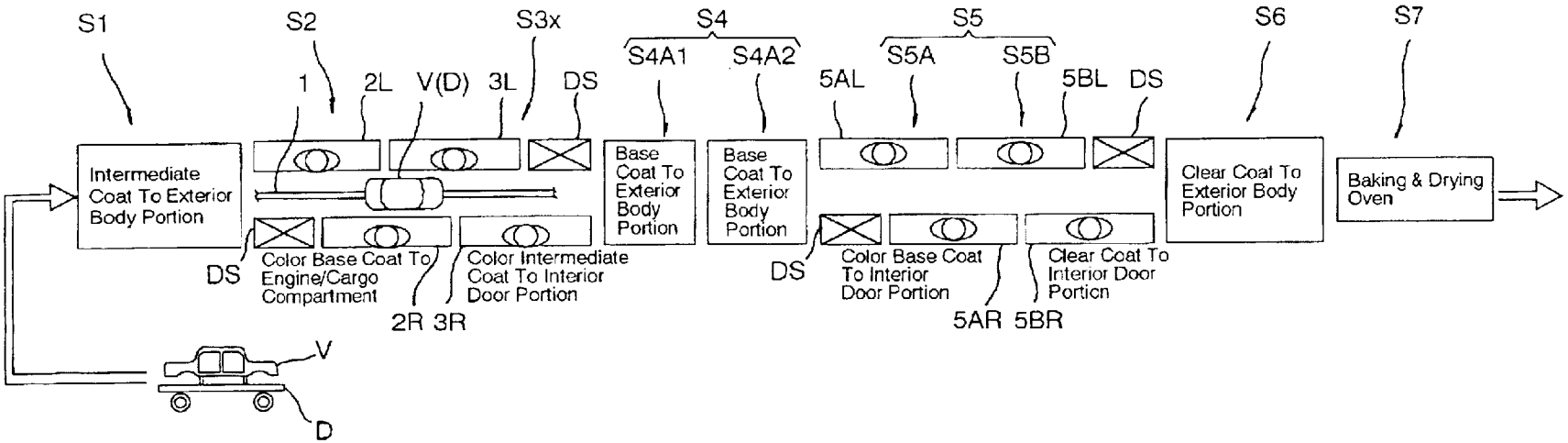
FIG. 5 is an illustration showing a painting line for carrying out a painting process according to a further embodiment of the present invention.

FIG. 5 shows a vehicle body painting line for painting a vehicle body in a process according to a further embodiment of the present invention in which an intermediate coat and an overcoat comprising a color base coats and a clear coat are applied to both the exterior body portion and the interior door portion of the vehicle body V. An undercoat has been applied using an electrodepositing process by which an undercoat layer is formed on all portions and compartments of the vehicle body V dipped in a coating composition bath. The undercoat layer has been baked and dried in a conventional oven. The vehicle body V is placed on the carrier D that is towed by a towing device 1 through a vehicle body painting line including first to second coating stations S1 and S2, an extra third coating station S3*x*, fourth to sixth coating stations S4 to S6 and a finishing station S7. The extra third coating station S3*x* is the same in structure and operation as the third coating station S3 of the previous embodiment but used to apply an intermediate coat, in place of the color base coat forming a part of the overcoat, to the interior door portion. The fourth coating station S4 where the base coat is applied to the exterior body portion of the vehicle body V includes a first substation S4A1 for a color base coat for the first time and a second substation S4A2 for the same color base coat for the second time.

When the vehicle body V placed on a carrier D is carried to a first coating station S1, a gray intermediate coat is applied to the exterior body portion of the vehicle body V using a robot or an automatic spray device, or otherwise a manually operated spray device. After the application of the gray intermediate coat to the exterior body portion of the vehicle body V in the first coating station S1, the vehicle body V is carried to between right and left spray booths 2R and 2L in a second coating station S2 where a color base coat is applied to engine and/or cargo compartments of the vehicle body V using a robot or an automatic spray device, or otherwise a manually operated spray device. The color of the color base coat is identical with or similar to a finished color of an overcoat that is applied to the exterior body portion of the vehicle body V in coating stations S4 and S6 that will be described later. The application of the color base coat to the engine and/or cargo compartments of the vehicle body V is made while the gray intermediate coat layer formed on the exterior body portion of the vehicle body V remains still wet. The color base coat is applied by spraying a color coating composition from right and left spray booths 2R and 2L on opposite sides of the vehicle body V. These right and left spray booths 2R and 2L are little displaced from each other in the vehicle body carrying direction in order to prevent a spray device operator on a side opposite to each spray device from being dabbed with an overspray of coating composition from the spray device.

After the application of the color base coat to the engine and/or cargo compartments of the vehicle body V in the second coating station S2, the vehicle body V is carried to an extra third coating station S3*x* where a color intermediate coat is applied to the interior door portion of the vehicle body V using a robot or an automatic spray device, or otherwise a manually operated spray device. The color of the color intermediate coat is identical with or similar to the color of the color base coat applied to the engine and/or cargo compartments in the second coating station S2. The application of the color intermediate coat to the interior door portion of the vehicle body V is made while the gray intermediate coat layer formed on the exterior body portion of the vehicle body V in the first coating station S1 and the color intermediate coat layer formed on the engine and cargo compartments in the second coating station S2 remain still wet. The color intermediate coat is applied by spraying a color coating composition from right and left spray booths 3R and 3L on opposite sides of the vehicle body V. These right and left spray booths 3R and 3L are little displaced from each other in the vehicle body carrying direction in order to prevent an spray device operator at a side opposite to each spray device from being dabbed with an overspray of coating composition from the spray device.

Subsequently to the application of the color intermediate coat to the engine and cargo compartments of the vehicle body V in the extra third coating station S3*x*, the vehicle body V is carried to a fourth coating station S4 where a color base coat forming a part of the overcoat is applied to the exterior body portion of the vehicle body V twice using a robot or an automatic spray device, or otherwise a manually operated spray device. The fourth coating station S4 comprises a first substations S4A1 for the color base coat for the first time and a second substation S4A2 for the color base coat for the second time. The application of the first color base coat to the exterior body portion of the vehicle body V is made while the coat layers formed on the vehicle body V in the first through extra third coating stations S1–S3*x* remain still wet. Similarly, the application of the second color base coat to the exterior body portion of the vehicle body V is made while the coat layers formed on the vehicle body V in the first to extra third coating stations S1–S3*x* and in the first substation S4A of the fourth coating station S4 remain still wet.

After the application of the color base coat to the exterior body portion of the vehicle body V twice in the fourth coating station S4, the vehicle body V is carried to a fifth coating station S5 where an overcoat comprising a color base coat and a clear coat is applied to the interior door portion of the vehicle body V using a robot or an automatic spray device, or otherwise a manually operated spray device. Specifically, the fifth coating station S5 comprises a first substations S5A for the color base coat and a second substation S5B for the clear coat. The application of the color base coat to the interior door portion of the vehicle body V is made while the coat layers formed on the vehicle body V in the first through fourth coating stations S1–S4 remain still wet. Similarly, the application of the clear coat applied to the interior door portion of the vehicle body V is made while the coat layers formed on the vehicle body V in the first to fourth coating stations S1–S4 and in the first substation S5A of the fifth coating station S5 remain still wet. The color base coat is applied by spraying a color coating composition from right and left spray booths 5AR and 5AL on opposite sides of the vehicle body V. These right and left spray booths 5AR and 5AL are little displaced from each other in the vehicle body carrying direction in order to prevent to prevent a spray device operator at a side opposite to each spray device from being dabbed with an overspray of coating composition from the spray device. Similarly, the clear coat is applied by spraying a clear coating composition from right and left spray booths 5BR and 5BL on opposite sides of the vehicle body V. These right and left spray booths 5BR and 5BL are little displaced from each other in the vehicle body carrying direction in order to prevent a spray device operator on a side opposite to each spray device from being dabbed with an overspray of coating composition from the spray device.

After the application of the overcoat comprising the color base coat and the clear coat to the interior door portion of the vehicle body V in the fifth coating station S5, the vehicle body V is carried to a sixth coating station S6 where a clear coat forming a part of the overcoat is applied to the exterior body portion of the vehicle body V using a robot or an automatic spray device, or otherwise a manually operated spray device. The application of the clear coat applied to the exterior body portion of the vehicle body V is made while the coat layers formed on the vehicle body V in the first through fifth coating stations S1–S5 remain still wet.

Finally, after the application of the clear coat to the exterior body portion of the vehicle body V in the sixth coating station S6, the vehicle body V is carried to a finishing station S7 where the coat layers formed on the vehicle body V all of which remain wet are baked and dried all together in a conventional baking and drying oven. The vehicle body V finished by baking and drying the coat layers is transported to an assembly line (not shown).

As shown FIG. 5, there are four dead spaces DS, that is small in number, in the coating stations S2, S3*x* and S5 in the painting line resulting from that the right and left spray booths in each of the coating stations S2, S3*x* and S5 are displaced from each other in the vehicle body carrying direction. Specifically, there is one dead space DS adjacent to each of the right spray booth 2R in the second coating station S2, the left spray booth 3L in the extra third coating station S3, the right spray booth 5AR in the first substation S5A of the fifth coating station S5 and the left spray booth 5BL in the second sib-station S5B of the fifth coating station S5. The total number of dead spaces DS, that is four in this embodiment, is desirable in view of shortening the overall path length of the painting line as short as possible.

Figure 6:
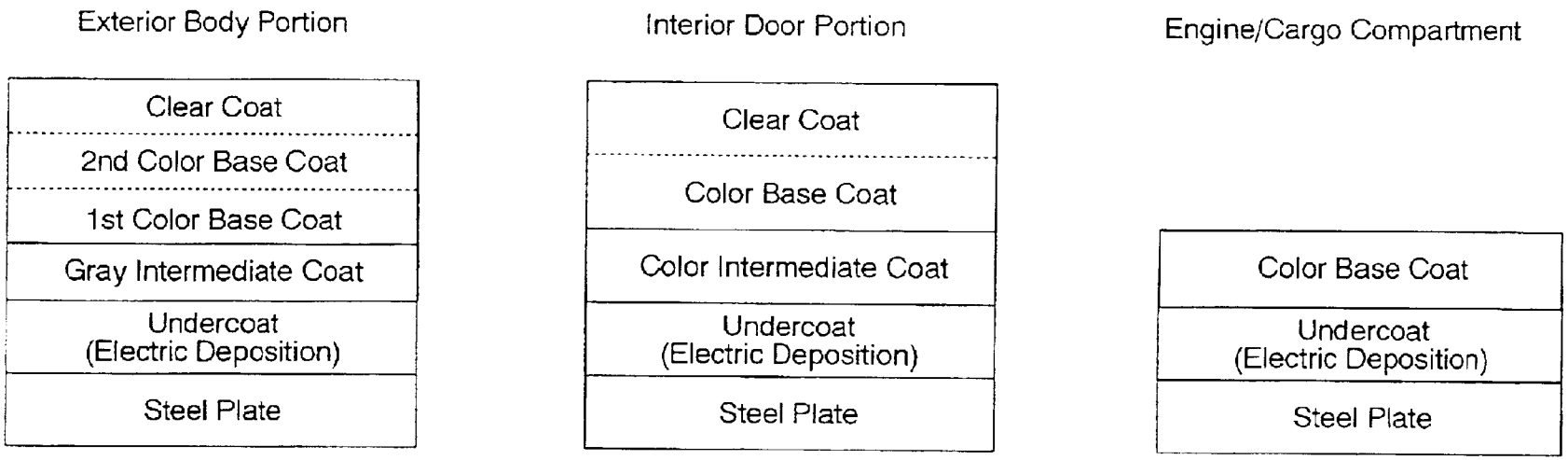
FIG. 6 is an illustration of coating structures of the respective portions of a vehicle body, namely an exterior body portion, engine and cargo compartments and an interior door portion, painted in the painting line of FIG. 5.

FIG. 6 shows a coating structure of the respective portions of the vehicle body V, namely the exterior body portion, the interior door portion and the engine and cargo compartments of the vehicle body V, formed in the vehicle body painting line of FIG. 5. As was described in connection with the previous embodiments, a steel panel and an undercoat which is applied to the steel panel are common to the respective portions of the vehicle body V. The gray coating composition that is comparatively cheap is employed for the intermediate coat applied to the exterior body portion of the vehicle body V. The application of the intermediate coat to the interior door portion is desirable for the interior door portion to be finished to the same quality of paintwork as the exterior body portion. While, in order to finish the engine and/or cargo compartments to the same or a similar color of the exterior body portion, the same color coating composition for the overcoat applied to the exterior door portion, it is possible to employ a color coating composition cheaper than the color coating composition for the overcoat applied to the exterior door portion. This makes the vehicle body painting inexpensive.

In addition, vehicle body painting line has no necessity of incorporating an oven exclusive to baking and drying the intermediate coat layers, therefore, it is possible to cut costs, namely costs of painting appliances and a painting cost, and to reduce energy consumption and painting time. In addition, the vehicle body painting process is made effectively intensive in the vehicle body painting line and increases the design flexibility of painting works.

Examining the quality of paintwork of the vehicle body V in connection with an overspray, since an application of individual coat is made while all coat layers formed previous to the individual coat remain wet, there occurs no defects of paintwork. Further, since there is no overspray of a coating composition of a color different from a desired color, there does not in any way occur a problem in color mixing due to an overspray. If the intermediate coat were applied to the exterior body portion of the vehicle body V after an application of the color base coat to the engine and/or cargo compartments of the vehicle body V, it is necessary for the intermediate coat to employ a color coating composition other than a gray coating composition for the intermediate coat of the exterior body portion.

Vehicle body Printing lines described above can be varied in various forms. Specifically, the printing line shown in FIG. 1 may be varied by replacing the second and third coating stations S2 and S3 with each other. That is, in the vehicle body printing process implemented in the variant vehicle body printing line, an application of the color intermediate coat to the engine and/or cargo compartments is made after an application of the color base coat to the interior door portion following an application of the intermediate coat to the exterior vehicle body. In this case, the coating composition for the color intermediate coat applied to the engine and/or cargo compartments is desirable to employ the same coating composition as employed for the color base coat applied to the exterior vehicle body in consideration with an overspray against the interior door portion. Further to or alternatively to the replacement of the second and third coating stations with each other, the vehicle body printing line shown in FIG. 1 may be varied by removing the fifth and sixth coating stations S5 and S6. That is, in the vehicle body printing process implemented in the variant vehicle body printing line, the overcoat for each of the exterior vehicle panel and the interior door portion may be completed without applying the clear coat. In this alternative vehicle body painting line, the overcoat can be completed by spraying a coating composition selected from the group of solid type coating compositions, especially the group of white solid coating compositions.

Vehicle body printing line shown in FIG. 3 may be varied by replacing the second and third coating stations S2 and S3 with each other. That is, in the vehicle body printing process implemented in the variant vehicle body printing line, an application of the color base coat to the engine and/or cargo compartments is made after an application of the color base coat to the interior door portion following an application of the intermediate coat to the exterior door portion. In addition, the vehicle body printing line shown in FIG. 3 may be varied by replacing the second substation S5B in the fourth coating station S4 and the fifth coating station S5 with each other. That is, in the vehicle body printing process implemented in the variant vehicle body printing line, an application of the bright base coat to the exterior body portion may be made after an application of the bright base coat to the interior door portion following an application of the color base coat to the exterior body portion. While this alternative vehicle body painting line is desirable for the purpose of finishing the exterior door portion to an improved quality of overcoat, there is brought about an increase in the number of dead spaces DS by two as compared with the original printing line.

Vehicle body printing line shown in FIG. 5 may be varied by replacing the first and second coating stations S1 and S2 with each other like the variant of the vehicle body printing line shown in FIG. 1. In this case, a coating composition for the intermediate coat applied to the interior door portion may be the same coating composition as employed for the intermediate coat applied to the exterior body portion, i.e. the gray coating composition, Further, the vehicle body printing line shown in FIG. 5 may be varied by replacing the fourth coating station S4 and the first substation S5A of the fifth coating station S5 with each other and/or the second substation S5B and the sixth coating station S6 with each other. In the respective cases, the engine and/or cargo compartments may be coated with a color intermediate coating composition in place of a color base coating composition.

In the embodiments described above, the intermediate coat applied to the exterior body portion of the vehicle body V in the coating station S1 may be replaced with a color intermediate coat. The coat applied to the engine and/or cargo compartments of the vehicle body V may be the same color base coat as applied to the exterior body portion of the vehicle body V in place of the color intermediate coat (the first embodiment) or may be of the same color intermediate coat as applied to the exterior body portion in place of the color base coat (the second and third embodiments). In the case where a color base coat is applied to the interior door portion of the vehicle body V or the engine and/or cargo compartments of the vehicle body V, a color base coat generally employed for an interior body panels of the vehicle body V that is cheaper than that employed for the exterior body portion may be employed. In the second coating station S2, either the intermediate coat or the color base coat may be applied to both or either one of the engine and cargo compartments of the vehicle body V according to body configurations. Further, a clear coat may be applied to the engine and/or cargo compartments of the vehicle body V in order to improve the quality of paintwork.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A vehicle body painting process of painting a vehicle body comprising an exterior body portion, engine and cargo compartments and an interior door portion in which at least said exterior body portion is applied with an intermediate coat and an overcoat comprising at least a color base coat and a clear coat, said vehicle body painting process comprising the steps of:

a first coating step of applying said intermediate coat to said exterior body portion;

a second coating step of applying with said intermediate coat to at least one of said engine and cargo compartments after said first coating step;

a third coating step of applying said color base coat to said interior door portion at least after said first coating step;

a fourth coating step of applying said color base coat to said exterior body portion after both said second coating step and said third coating step;

a fifth coating step of applying said clear coat to said interior door portion after said fourth coating step;

a sixth coating step of applying said clear coat to said exterior body portion at least after said fourth coating step; and a baking and drying step of baking and drying coat layers formed in said first through sixth coating steps all together;

wherein each of said second to sixth coating steps is made while said coat layers formed in said coating steps preceding said each coating step remain wet and said intermediate coat applied to said engine and cargo compartments is identical with either one of said intermediate coat and said color base coat and has a color identical with or similar to said color base coat.

2. A vehicle body painting process as defined in claim 1, wherein a coating composition for said intermediate coat applied to said engine and cargo compartments is identical with that for said color base coat.

3. A vehicle body painting process as defined in claim 1, wherein a coating composition for said intermediate coat applied to said exterior body portion is gray in color.

4. A vehicle body painting process as defined in claim 1, wherein said application of said color base coat to said interior door portion is made directly after said application of said intermediate coat to said engine and cargo compartments.

5. A vehicle body painting process as defined in claim 1, wherein a coating composition for said color base coat comprises one selected from a group of brightener contained coating compositions and a group of solid coating compositions.

6. A vehicle body painting process of painting a vehicle body comprising an exterior body portion, engine and cargo compartments and an interior door portion in which at least said exterior body portion is applied with an intermediate coat and an overcoat comprising at least a color base coat, a bright base coat and a clear coat, said vehicle body painting process comprising the steps of:

a first coating step of applying an intermediate coat to said exterior body portion;

a second coating step of applying an intermediate coat to at least one of said engine and cargo compartments after said first coating step;

a third coating step of applying said color base coat to said interior door portion at least after said first coating step;

a fourth coating step of applying said color base coat to said exterior body portion after both said second coating step and third coating step;

a fifth coating step of applying said bright base coat to said exterior body portion after said fourth coating step;

a sixth coating step of applying said bright base coat to said interior door portion at least after said fourth coating step;

a seventh coating step of applying said clear coat to said interior door portion after both said fifth coating step and said sixth coating step;

a eighth coating step of applying said clear coat to said exterior body portion after both said fifth coating step and said sixth coating step; and a baking and drying step of baking and drying coat layers formed in said first through eighth coating steps all together;

wherein each of said second to eighth coating steps is made while said coat layers formed in said coating steps preceding said each coating step remain wet and said intermediate coat applied to said engine and cargo compartments is identical with either one of said intermediate coat and said color base coat and has a color identical with or similar to said color base coat.

7. A vehicle body painting process as defined in claim 6, wherein a coating composition for said intermediate coat applied to said engine and cargo compartments is identical with that for said color base coat.

8. A vehicle body painting process as defined in claim 6, wherein said application of said color base coat to said interior door portion is made directly after said application of said intermediate coat to said engine and cargo compartments.

9. A vehicle body painting process as defined in claim 6, wherein said application of said bright base coat to said interior door portion is made directly after said application of said bright base coat to said exterior body portion.

10. A vehicle body painting process as defined in claim 9, wherein a coating composition for said intermediate coat applied to said exterior body portion is gray in color.

11. A vehicle body painting process as defined in claim 6, wherein said application of said bright base coat to said exterior body portion is made directly after said application of said bright base coat to said interior door portion.

12. A vehicle body painting process as defined in claim 11, wherein a coating composition for said intermediate coat applied to said exterior body portion is gray in color.

13. A vehicle body painting process as defined in claim 6, wherein a coating composition for said intermediate coat applied to said exterior body portion is gray in color.

14. A vehicle body painting process as defined in claim 6, wherein said application of said color base coat to said interior door portion is made directly after said application of said intermediate coat to said engine and cargo compartments and said application of said bright base coat to said interior door portion is made directly after said application of said bright base coat to said exterior body portion.

15. A vehicle body painting process as defined in claim 14, wherein a coating composition for said intermediate coat applied to said exterior body portion is gray in color.

16. A vehicle body painting process as defined in claim 6, wherein a coating composition for said bright base coat contains bright as a brightener material.

17. A vehicle body painting process as defined in claim 16, wherein a coating composition for said intermediate coat applied to said exterior body portion is gray in color.

18. A vehicle body painting process of painting a vehicle body comprising an exterior body portion, engine and cargo compartments and an interior door portion in which at least said exterior body portion is applied with an intermediate coat and an overcoat comprising at least a color base coat and a clear coat, said vehicle body painting process comprising the steps of:

a first coating step of applying said intermediate coat to said exterior body portion;

a second coating step of applying said intermediate coat to at least one of said engine and cargo compartments after said first coating step;

a third coating step of applying said intermediate coat to said interior door portion at least after said first coating step;

a fourth coating step of applying said color base coat to said exterior body portion after both said second coating step and said third coating step;

a fifth coating step of applying said color base coat to said interior door portion after both said second coating step and third coating step;

a sixth coating step of applying said clear coat to said interior door portion after both said fourth coating step and said fifth coating step;

a seventh coating step of applying said clear coat to said exterior body portion after both said fourth coating step and said fifth coating step; and a baking and drying step of baking and drying coat layers formed in said first through seventh coating steps all together;

wherein each of said second to seventh coating steps is made while said coat layers formed in said coating steps preceding said each coating step remain wet and said intermediate coat applied to said engine and cargo compartments is identical with either one of said intermediate coat and said color base coat and has a color identical with or similar to said color base coat.

19. A vehicle body painting process as defined in claim 18, wherein a coating composition for said color base coat comprises one selected from a group of brightener contained coating compositions and a group of solid coating compositions.

20. A vehicle body painting process as defined in claim 18, wherein a coating composition for said intermediate coat applied to said engine and cargo compartments is identical with that for said color base coat.

21. A vehicle body painting process as defined in claim 18, wherein said application of said color base coat to said interior door portion is made directly after said application of said intermediate coat to said engine and cargo compartments.

22. A vehicle body painting process as defined in claim 18, wherein said application of said color base coat to said interior door portion is made directly after said application of said color base coat to said exterior door portion.

23. A vehicle body painting process as defined in claim 18, wherein said application of said intermediate coat to said interior door portion is made directly after said application of said intermediate coat to said engine and cargo compartments, said application of said color base coat to said exterior body portion is made directly after said application of said intermediate coat to said interior door portion, and said application of said color base coat to said interior door portion is made directly after said application of said color base coat to said exterior body portion.

24. A vehicle body painting process as defined in claim 18, wherein said application of said color base coat to said exterior body portion is made directly after said application of said color base coat to said interior door portion.

25. A vehicle body painting process of painting a vehicle body comprising an exterior body portion, engine and cargo compartments and an interior door portion in which at least said exterior body portion is applied with an intermediate coat and an overcoart comprising at least a color base coat, said vehicle body painting process comprising the steps of:

a first coating step of applying said intermediate coat to said exterior body portion;

a second coating step of applying said intermediate coat to at least one of said engine and cargo compartments after said first coating step;

a third coating step of applying said color base coat to said interior door portion at least after said first coating step;

a fourth coating step of applying said color base coat to said exterior body portion after both said second coating step and said third coating step; and a baking and drying step of baking and drying coat layers formed in said first through fourth coating steps all together;

wherein each of said second to fourth coating steps is made while said coat layers formed in said coating steps preceding said each coating step remain wet, a coating composition for said color base coat comprises one selected from a group of solid coating compositions, and said intermediate coat applied to said engine and cargo compartments is identical with either one of said intermediate coat and said color base coat and has a color either identical with or similar to said color base coat.

* * * * *